US006782636B2

(12) United States Patent
Feldman

(10) Patent No.: US 6,782,636 B2
(45) Date of Patent: Aug. 31, 2004

(54) DEVICE FOR DRYING AND STYLING HAIR

(76) Inventor: Beatriz Monica Feldman, Laprida 1351 - 6°A, Buenos Aires (AR), 1425

( * ) Notice: Subject to any disclaimer, the term of this patent is extended or adjusted under 35 U.S.C. 154(b) by 0 days.

(21) Appl. No.: 10/378,389

(22) Filed: Mar. 3, 2003

(65) Prior Publication Data

US 2003/0163930 A1 Sep. 4, 2003

(30) Foreign Application Priority Data

Mar. 4, 2002 (AR) ..... P020100777

(51) Int. Cl.[7] ..... A45D 1/00
(52) U.S. Cl. ..... 34/96; 132/272; 392/383
(58) Field of Search ..... 34/282, 96, 97, 34/98, 99, 100, 101; 392/380, 383, 384; 219/222; 132/271, 272, 220

(56) References Cited

U.S. PATENT DOCUMENTS 4,112,591 A 9/1978 Marsh
4,409,998 A * 10/1983 Bauer ..... 132/227
4,691,451 A 9/1987 Giorgis
4,906,804 A * 3/1990 Theimer ..... 200/52 R
5,058,193 A * 10/1991 Appierto ..... 392/384
5,279,048 A 1/1994 Lawall et al.
5,592,749 A 1/1997 Trimmer
5,651,190 A 7/1997 Sanders
5,761,825 A 6/1998 Ammon et al.
5,940,980 A 8/1999 Lee et al.
5,956,861 A 9/1999 Barnes
6,317,998 B1 * 11/2001 Benevelli ..... 34/97
6,532,968 B1 3/2003 Hafemann

* cited by examiner

*Primary Examiner*—Henry A. Bennett
*Assistant Examiner*—Camtu Nguyen
(74) *Attorney, Agent, or Firm*—Hughes Hubbard & Reed LLP; Ronald Abramson; Douglas D. Zhang

(57) ABSTRACT

The present invention comprises a hot air generator having hand fastening means; projecting therefrom there is a rigid tube with a lower outlet, tilted so as to face the hair, and a rotatably mounted flexible hose, attached in the same manner at its other end and having a handgrip provided with an internal tube; the distal end of said internal tube can be alternately attached either to a brush intended for brushing purposes, having aeration holes in its body, or to a flat surface ironing accessory, said accessory being complemented by a similar and opposed accessory connected to the rigid tube, so that any of the two operations may be conducted with only one hand; the first operation by directing the air flow from the rigid tube towards the hair external layers while carrying out the styling and drying operations of the hair internal layers by means of the cylindrical brush, and the second operation, by contacting the flat area of the rigid tube ironing accessory, heated by the latter, with the external layers and pressing the flat portion of the opposing accessory with a sliding motion, which is heated from the handgrip.

16 Claims, 6 Drawing Sheets

DEVICE FOR DRYING AND STYLING HAIR

This application claims priority to foreign Argentina Application No. P 02 01 00777, filed on Mar. 4, 2002.

The present invention relates to a HAIR STYLER/DRYER, wherein the operations of styling or drying the hair can be conducting using one hand.

BACKGROUND OF THE INVENTION

Embodiments included in the prior art and most resembling this invention are hair dryer devices comprising a housing with an electrical motor therein, such motor causing a forced ventilation receiving heat from an electrical resistance through which said heat passes, the hot air flow being expelled by a nozzle, directed to the hair by the user from hand-held means.

Accordingly, the following are registered cases of the prior art, among many other embodiments included in the public domain:

EP 1,070,459 A2, IMPROVEMENTS ON HAIR DRYER APPARATUSES, which discloses a housing having a transversal handgrip.

U.S. Pat. No. 6,317,998, equivalent to the above-referred patent.

U.S. Pat. No. 5,592,749, HANDS FREE HAIR DRYER, having a table top air generator and axial grip at its flexible hose.

U.S. Pat. No. 5,279,048, HANDS FREE HAIR DRYER AND ACCESSORIES, characterized by its cylindrical air generator, its hose and supporting structure.

U.S. Pat. No. 5,940,980, HANDS FREE HAIR DRYER, having a semi-rigid hose and spring clamp supporting means.

U.S. Pat. No. 5,956,861, WALL MOUNTABLE HAIR DRYER AND SUPPORT, to be used by holding the end of its hose.

U.S. Pat. No. 4,691,451, HAIR DRYER, having external heat screen oriented towards the air flow.

U.S. Pat. No. 4,112,591, HAIR DRYER; characterized by a pliable hood.

U.S. Pat. No. 5,651,190, HANDS FREE HAIR DRYER, provided with hood and self-contained power supply.

U.S. Pat. No. 5,761,825, HANDS FREE HAIR DRYER AND SUPPORT.

WO 99/01049, DRYER WITH BATTERY CHARGER DEVICE, on which said dryer is placed when not in use to recharge its storage battery.

PCT/EP 99/05039, HAIR DRYER ACCESORY, having penetrating nozzles to penetrate the hair mass.

WO 01/15568 A1, HOT AIR DIFFUSER ACCESSORY BRUSH FOR HANDHELD HAIR DRYERS, having coupling means and internal tube with radial outlets.

Unlike the present invention which was conceived for both hair brushing and ironing purposes, all of the foregoing are hair dryers or its accessories intended for hair drying only, except for WO 01/15568 A1, which teaches a cylindrical brush for brushing purposes. As disclosed, said brush is not capable of independent rotation from the dryer, i.e., both the brush and the dryer make the rotation motion necessary for brushing purposes as a unit, a motion which is limited by the twisting of its supply cable. In addition, this accessory cannot be used for hair ironing, as opposed to that for which the present application was conceived.

In the other cases, the brushing operation comprises the steps of running a cylindrical brush towards the hair ends and concomitantly rotating said brush on the hair internal layers, while simultaneously receiving the drying provision of the hot air flow over external layers, produced by the hair dryer.

This means that when taking the invention to practice, the user has to handle the brush with one hand while holding the dryer externally oriented to the brushed area with the other hand, which forces said user to adopt awkward positions that make impossible, especially in some areas, for the user to style his or her own hair.

Furthermore, by using the foregoing method a heterogeneous drying between the hair external layers, more exposed to the hot air flow, and the hair internal layers which while damp, oppose resistance to styling action and when dried are subjected to an excessive drying because of the external provision of hot air on the external layers, is achieved.

For hair ironing, a function also contemplated within the scope of this invention by simply changing the accessories, the prior art includes hair irons comprising a pair of tongs, having flat metal blades heated by an electrical resistance contained therein; when tong blades are in the open position, hair is placed between them, and when they come together, hair is pressed against them, so that straightening is achieved by running the closed tong blades thereon.

In addition to having been conceived for this application only, said hair irons have several drawbacks, e.g. cumbersome heat regulation, electrical hazards, and potential damage to hair due to excessive heat application.

SUMMARY OF THE INVENTION

The present invention aims at overcoming the foregoing problems, by optimizing hair brushing and ironing actions.

The main object of this Patent application is providing a styling device comprising a hot air supply to which the corresponding brushing and styling accessories are alternatively attached, so as to perform both actions using only one hand. This allows the necessary rotation of the brush for hair brushing purposes, and heating the iron accessories by air flow; in addition there is no damage potential, homogenous drying, and in the absence of said accessories, said device acts as a simple hair dryer.

Essentially, a hot air generator contained in a housing is provided. Its bottom anatomically fits the external metacarpal region of the hand, for which purpose it is provided with a preferably elastic, rear wrist band; said band has fastening means and a front lower elastic ring, through which a finger of the same hand passes, thus enabling its conductive action.

From the front side area of the above-referred hot air generator—this being provided with slots, an air inlet, supply cable and an on-off switch—a rigid aeration tube inclined with respect to the frontal space is projected, with fine tuning capabilities of rotation and obliquity to optimize air flow orientation through its lower longitudinal outlet.

From an equivalent area but corresponding to the opposite side, a bending hose projects, the connection of which with the housing allows free rotation, and the opposite end of which is similarly attached to a handgrip having a longitudinal passing-through tube that allows hot air to flow therein, towards the distal coupling means; said coupling means are to be axially connected either to the cylindrical brush intended for brushing purposes, or to the corresponding accessory for ironing purposes, which accessory is complemented by another one, coupled to the above-referred rigid aeration tube outlet, that is removably connected by means of a dovetail joint.

The brush above features a cylindrical body having a longitudinal tube continuing the handgrip tube, and a plurality or perimetric holes arranged along its wall, with filaments through which the hot air emerges.

Iron accessories consist of hollow chambers with respective coupling means, the actuating plates of which have a smooth outer—ideally metallic—surface, provided with outlet holes for hot air, distributed throughout the surface; the one to be mounted to the handgrip has a plurality of internal partitions, intended to form a labyrinthical air flow path, thus promoting use of heat to the greatest advantage.

According to the above described arrangement and in order to conduct the brushing operation, the cylindrical brush is to be attached to the handgrip and then, holding the generator with the hand, proceed to direct the hot air flow coming from the rigid aeration tube towards the outer hair layers; at the same time, while holding the handgrip with same hand, the cylindrical brush contacts the hair internal layers for rotation, concomitantly with ventilation from its perimetric holes, so as to produce contemporaneous hair styling and homogeneous drying between both hot air flows.

In order to conduct hair ironing, the above described accessories should be attached as follows: one to the aeration rigid tube, and the other to the handgrip coupling means, thus positioning the first one facing the hair external layers, while the second one is brought close to the internal layers by using the same hand, until the hair mass is trapped between both smooth surfaces; a mild pressure should be exercised to provide concomitant sliding motion for ironing and heat provision.

Without departing from the functional principle above-described, an alternative variation is also contemplated, i.e., the option to have the hot air generator source not held by the user's hand, but connected at a certain distance to the handgrip, by means of a longer hose, in a similar manner to the basic conception described above; however, in this case, the rotating coupling means features a derivation obtained by the flexible tube to the aeration tube, which is non-rotatably connected to said coupling means, by an overhead hinged arm at a transverse axis, provided with an extension spring that tends to keep the handgrip and the aeration tube parallel, between the spring strain and a back end.

The aeration tube support has a lower trigger, intended to bring said support close to the handgrip axial projection, thus breaking the parallel configuration when over passing the expansion strain of the spring, with the thumb of the same hand holding the handgrip.

This way, the brushing operation is implemented by placing the hair between the aeration tube and the cylindrical brush attached to the rotating handgrip, separated from each other in a parallel configuration, to conduct brushing operation by rotation, from the internal layers of the hair mass.

In order to conduct the ironing operation, once the corresponding accessories have been attached, the only requirement is that hair is placed between both smooth faces and then bring said faces close to each other, with the thumb on the trigger, until sliding pressure thereof results in the simultaneous hair straightening and heat drying.

As commonly found in some hair salons, this alternative variation can be also applied to fixed air flow installations, by connecting the flexible hose to one of the network outlets; hot air may be fed in a pre-heated condition or by means of self-contained heat source.

BRIEF DESCRIPTION OF THE DRAWINGS

In order obtain the advantages briefly described above and to understand better the construction and functional characteristics of the Hair Styler/Dryer, a preferred embodiment and variants thereof are described herein below, which are schematically depicted at no specific scale in the appended drawings. It is to be expressly understood that given its exemplary and non-limiting nature, said embodiments an variants should be construed only as a mere illustration of the basic conception hereof.

DETAILED DESCRIPTION OF THE DRAWINGS

The present invention relates to a HAIR STYLER/DRYER, comprising a hot air generator with hand fastening means to be secured above the hand's metacarpal region; projecting therefrom there is a rigid tube, with a lower outlet suitably tilted so as to face the hair, and a flexible hose capable of rotation at its joint, similarly connected by its other end to a handgrip; said handgrip is provided with a pass-through inner tube, the distal end of which can be attached either to a brush for brushing purposes, the body of said brush having aeration holes, or to a flat-surface ironing accessory, which is complemented by a similar and opposed accessory, jointly connected to the rigid tube, so that any of the two operations can be conducting using one hand; in the first case, by directing the air flow from the rigid tube towards the hair external layers while styling and drying the internal layers by the use of the cylindrical brush, and in the second case, by contacting the flat portion of the rigid tube accessory, heated by the latter with the external layers, and by pressing such flat portion of the opposing accessory, heated from the handgrip in a sliding motion.

Figure 1:
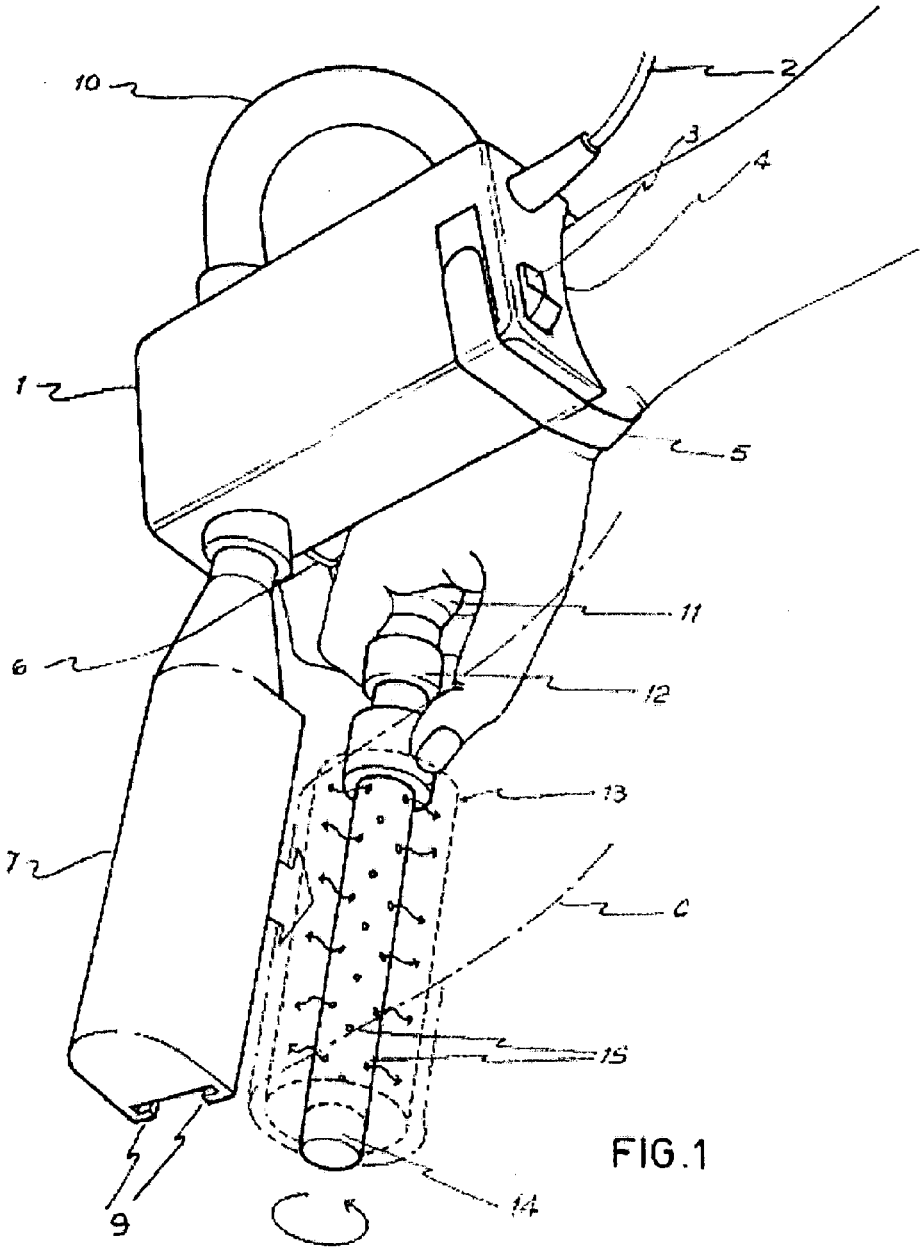
FIG. 1 is a perspective view of the user's hand conducting a brushing operation.

As shown in FIG. 1, the hot air generator 1, with its electrical cable 2 related to the electrical network and activated by its on-off switch 3, is fastened to the external metacarpal region of the operating hand at its anatomic base 4; said generator being fastened to the hand by means of a (preferably elastic) wrist band 5, which in this case is provided with a contact locking means—not excluding other types of locking means—and to a conducting finger by means of a the lower ring 6.

Figure 8:
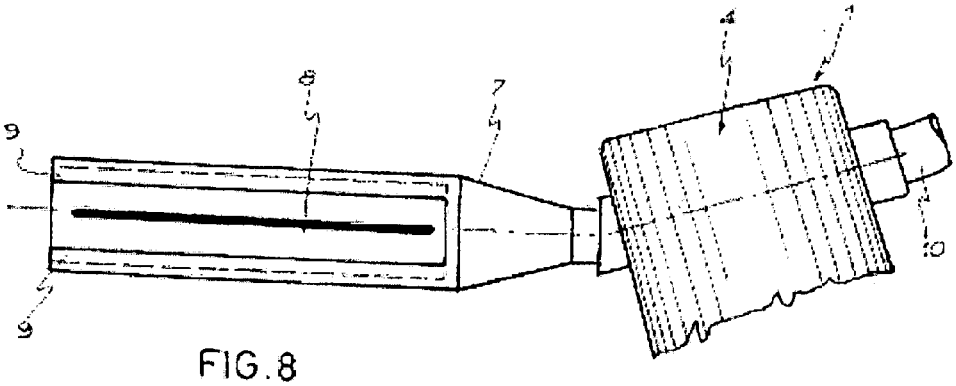
FIG. 8 is a bottom plan view of the rigid aeration tube, partially showing the hot air generator housing.

Being suitably tilted for proper orientation of air flow towards the hair external layers C, a rigid aeration tube 7 projects from the frontal side region, with fine tuning capabilities of obliquity and direction from coupling means thereof; this is provided with a linear air outlet 8 at its lower portion, as shown in FIG. 8, and longitudinal guides 9, of a dovetail joint, to receive the proper accessory for ironing operations.

In an equivalent area of the opposite side 1, a flexible hose 10 is rotatably attached to the air generator, so that the flexible hose distal end is also rotatably attached to the handgrip 11, which has non-rotating coupling means 12 at its free end, to which a cylindrical brush 13 is attached; the filamentous volume of this is represented with a broken line, and its body 14 shows a plurality of air vent holes 15; the above-referred brush can be changed as needed according to the different diameters required.

In the functional brushing conception depicted by this figure, the hand with the air generator 1 mounted on it, holds the handgrip 11 and directs the hot air jet from the aeration tube 7, by its own flexion, and from its conducting ring 6, towards the hair external layers C; at the same time, by contacting the brush 13 (at a suitable distance) with the internal layers, it makes a rotating action, simultaneously drying the hair with the hot air coming from its holes 15 and from the generator 1, through the hose 10, and the longitudinal tube of the handgrip 11.

Figure 2:
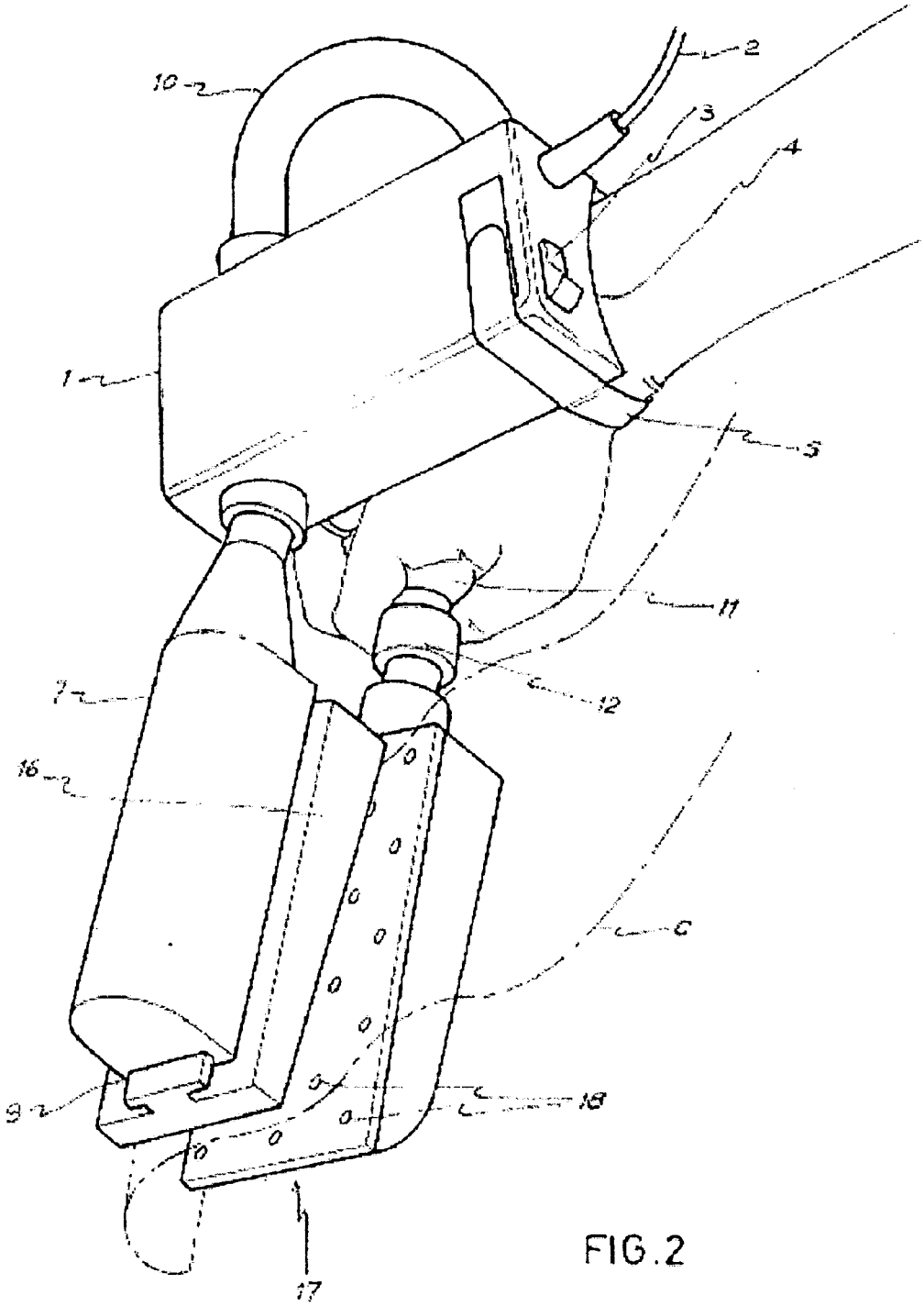
FIG. 2 is a view equivalent to the one above, conducting a hair ironing operation.

In a drawing similar to that above, FIG. 2 shows an ironing accessory 16 attached to the rigid aeration tube 7 by means of its sliding dovetail joint 9, as well as another complementary accessory 17, axially connected to the handgrip 11, both of them being provided with hot air outlet holes 18 at their facing flat portions.

With such arrangement, this figure depicts hair C placed between the flat face of the fixed accessory 16 and its counterpart face of accessory 17, attached to the handgrip 1, ready to be ironed; the user shall cause said flat faces to come together and finally contact each other, while exerting enough pressure to slide the entire assembly, so that favored by both the heating of both accessories and hot air outlet, promotes hair straightening; heat supply from the former is received along the entire extension thereof, from the rigid aeration tube, while the heating of the latter is caused by the hot air flow coming from the handgrip 11.

Figure 3:
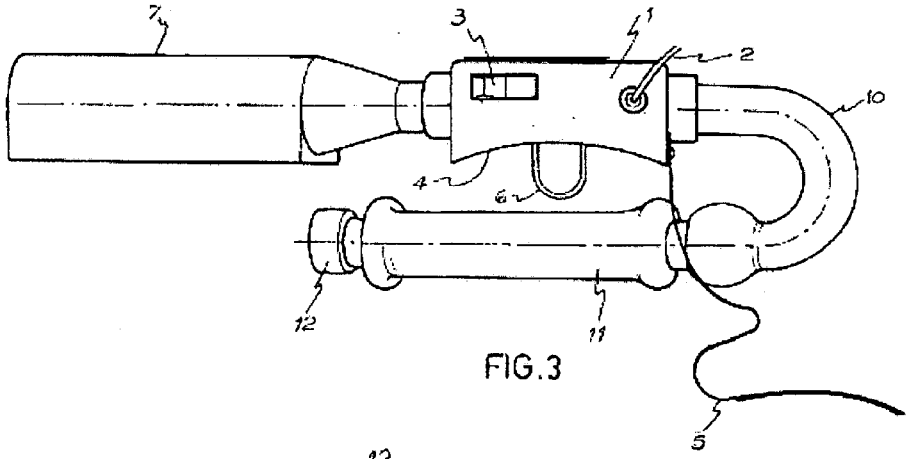
FIG. 3 is a rear elevational view of the hair styler/dryer.

FIG. 3 is a rear elevational view showing the hot air generator 1 provided with electrical cable 2, switch 3, concave anatomic base 4, wrist band 5 and conducting ring 6.

The tilted outlet of the rigid aeration tube 7 is shown at the left side, while the free rotating outlet of the flexible hose 10 is shown at the right side, the latter being similarly connected to the handgrip 11, distally provided with coupling means 12 to receive the corresponding accessory, the illustrated position being prone to variations for action thereof.

Figure 4:
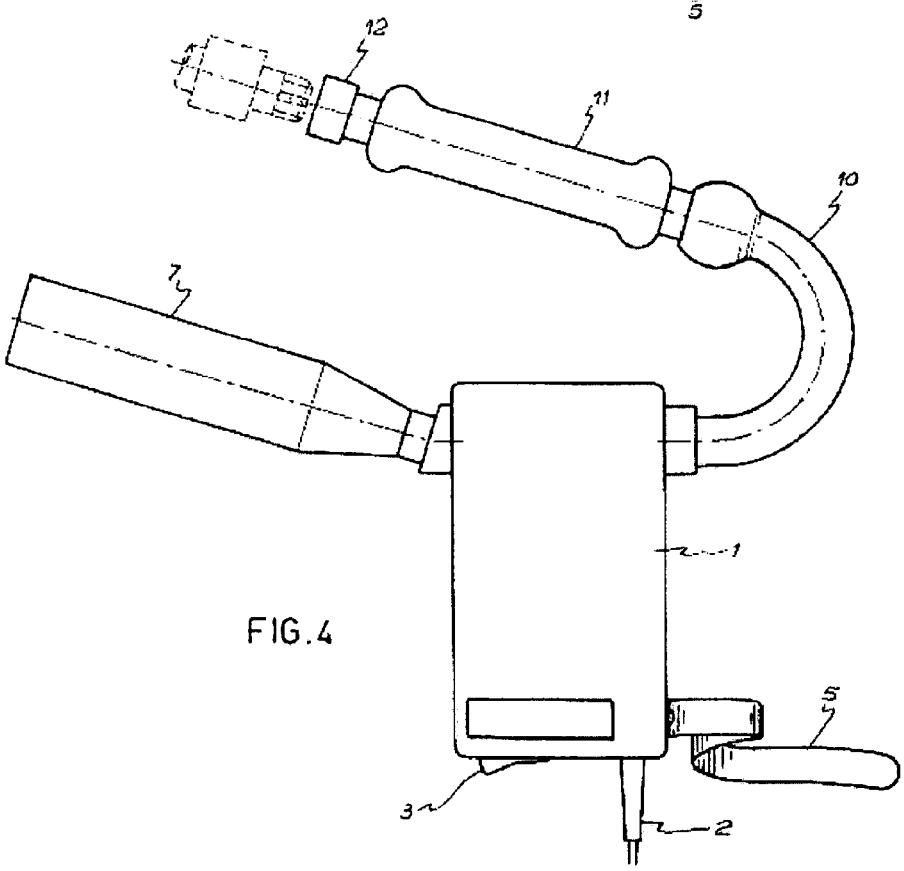
FIG. 4 is a top plan view thereof.

Complementing the figure above, FIG. 4 is a top plan view wherein the components having the same reference numbers are identified, the coupling means of an accessory, provided with longitudinal grooves to prevent rotation thereof from the handgrip, being represented by a broken line.

Figure 5:
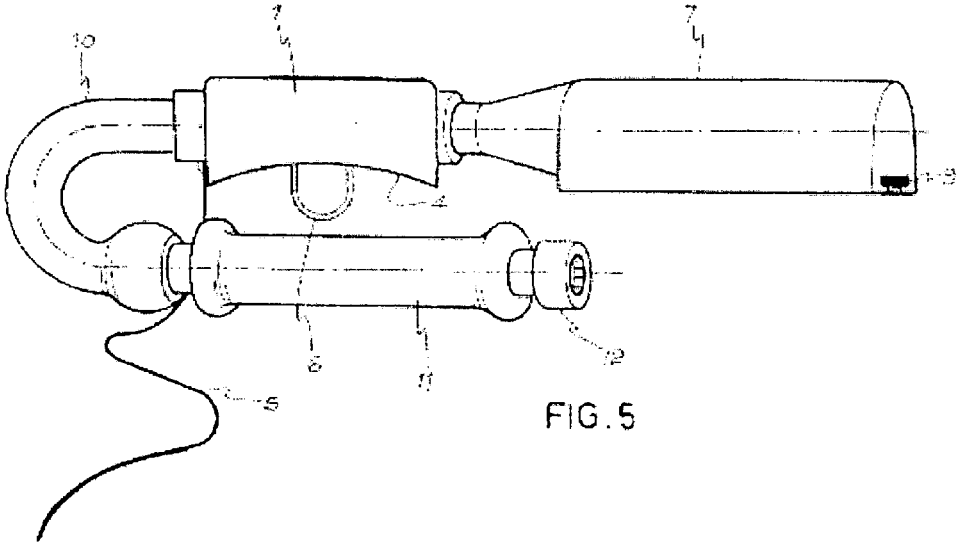
FIG. 5 is a front elevational view thereof.

Having the same reference numbers, the front elevational view depicted by FIG. 5, shows the dovetail joint silhouette 9 for connection thereof with the ironing accessory at the rigid aeration tube 7 and the coupling mouth 12 of the handgrip 11, its grooves showing that they prevent the corresponding accessory from rotating.

Figure 6:
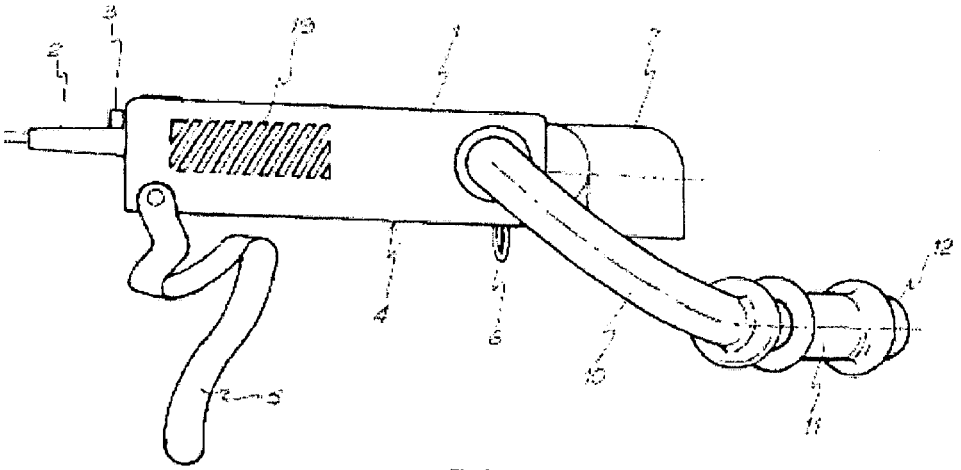
FIG. 6 is a side elevational view thereof

FIG. 6 is an elevational view of the side opposite to that shown in FIGS. 1 and 2, to depict the air intake 19 of the forced and heated air generator 1.

Figure 7:
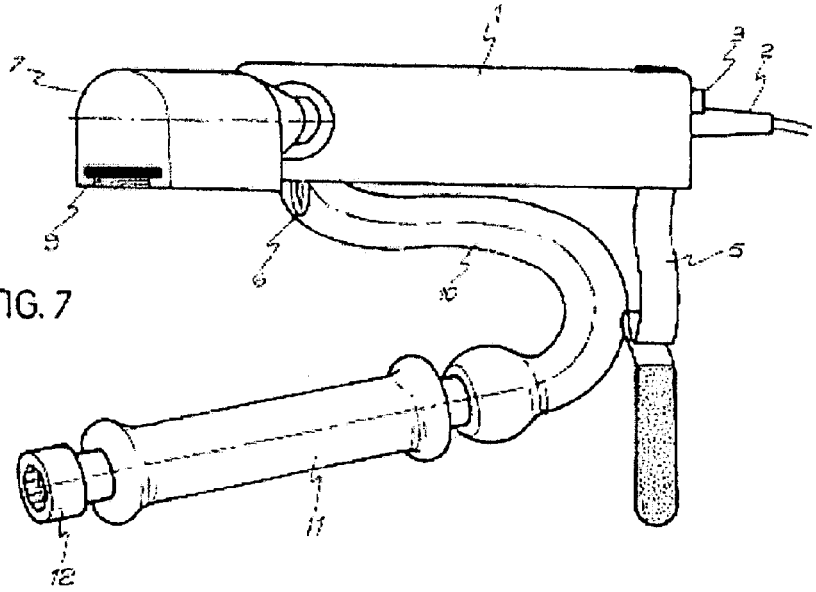
FIG. 7 is a side elevational view thereof, opposed to the preceding one.

FIG. 7, which also maintains the same reference numbers, illustrates a side elevational view opposed to that of FIG. 6, wherein the rigid aeration tube 7 shows the frontal arrangement of the dovetail joint 9 in greater detail, and also a different handgrip position.

In order to show the hot air outlet 8 of the rigid aeration tube 7 a lower plan view of FIG. 8 is provided, which shows the longitudinal engagement means 9 and the convexity of the anatomic base 4 of the hot air generator more clearly, the latter, like the flexible hose 10, being partially shown.

Figure 9:
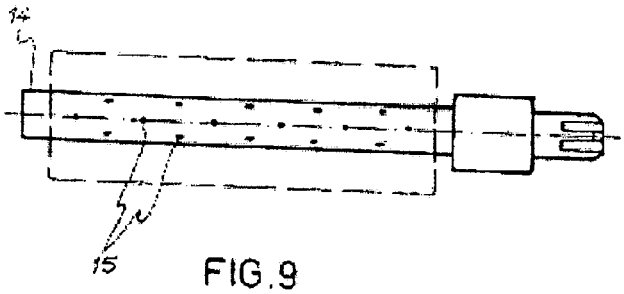
FIG. 9 is a side elevational view of the cylindrical brush intended for brushing operation.

FIG. 9 is an elevational view of the cylindrical brush, the brushing accessory, which can be selected from a range of differently calibrated accessories, showing its body 14 with holes 15, its grooved end for attachment thereof to the handgrip and the filamentous volume represented with a broken line.

Figure 10:
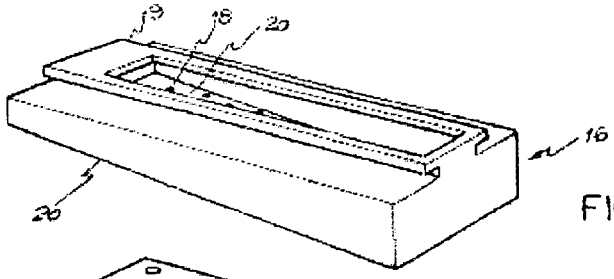
FIG. 10 is a perspective view of the ironing accessory, corresponding to the rigid aeration tube.

FIG. 10 perspective represents an ironing accessory 16 to be mounted by its engagement means 9 to the rigid aeration tube, and to receive hot air therefrom on its acting wall 20, with a multiplicity of outlet holes 18 and preferably featuring a smooth, polished and metallic coating.

Figure 11:
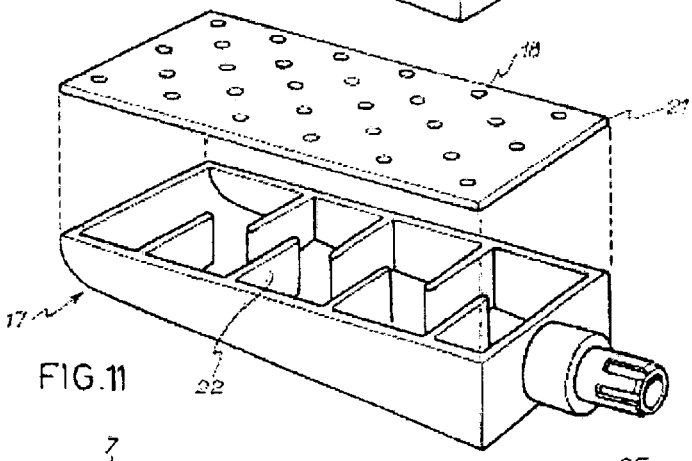
FIG. 11 is an exploded perspective view of the ironing accessory, corresponding to the handgrip.

In FIG. 11, the perspective of the ironing accessory 17, being attached to the handgrip, was represented with its actuating wall 21, with air outlet holes 18; preferably, said wall is smooth, metallic, and shifted to show the transversal partitions 22 of its hollow chamber, so that the hot air flow describes a winding path in order to take the greatest advantage of heat. This figure is shown at the grooved coupling means.

Figure 12:
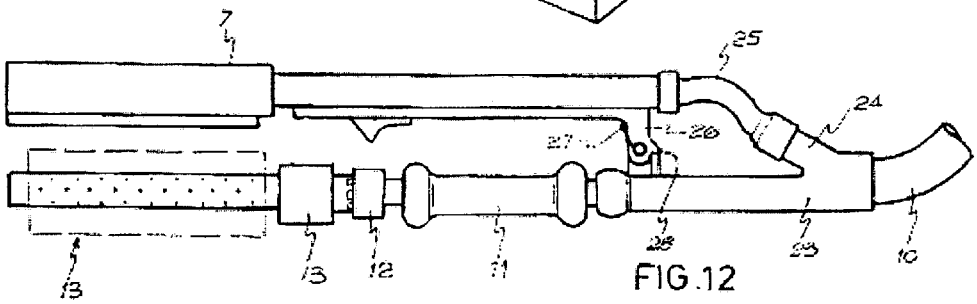
FIG. 12 is a side elevational view of the above-described alternative, while brushing.

FIG. 12 represents in a side elevational view, the alternative to a Hair Styler/Dryer with a distant hot air generator providing the flow through hose 10, which is longer and rotatably connected by a coupling means 23 to the handgrip 11; the free end of said handgrip is attached to the brush 13, to conduct the brushing operation, and to the rigid aeration tube 7, by means of bypass 24 by means of flexible tube 25; said aeration tube is joined to the coupling means 23 by a hinged member 26, the extension spring of which 27 keeps it in a parallel configuration up to the butt end 28.

Figure 13:
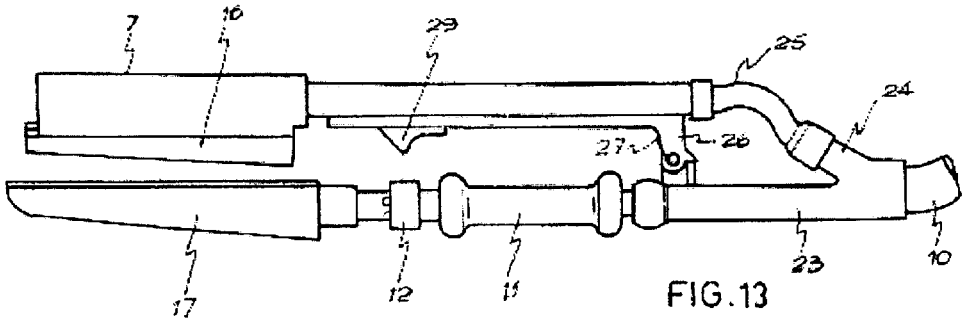
FIG. 13 is a view equivalent to the preceding one, while ironing.

The same arrangement of the figure above is shown in FIG. 13, but in this case, having accessories 16 and 17 attached thereon to conduct hair ironing operation; in order to bring them together, the trigger 29 must be pushed forward, thus over passing the expansion strength of the spring 27, whereby the actuating face of the former occupies an inclined plane, compensating the angular shift until contacting a common plane with its opponent 17.

The Hair Styler/Dryer above described and exemplified is within the scope of protection this Letters Patent application provides, which is essentially determined by the following appended claims.

What is claimed is:

1. A hair dryer/styler, comprising:

a hot air generator having a housing which defines a chamber therein and has a bottom wall and an air inlet;

a fastener for removably securing the hot air generator to a user's hand with the bottom wall resting on the external metacarpal region of the user's hand;

an aeration tube having a proximal end, a closed distal end and a side air outlet, the aeration tube being pivotally attached at the proximal end to the housing of the hot air generator and communicating with the chamber therein;

a handgrip having a proximal end, a distal end and a passage extending therethrough;

a flexible hose having a proximal end attached to the housing of the hot air generator and communicating with the chamber therein and a distal end rotatably attached to the proximal end of the handgrip and communicating with the passage of the handgrip;

a coupling ring member attached to the distal end of the handgrip;

a hair styling accessory removably attached to the coupling ring member; and wherein the user may use the hand secured with the hot air generator to adjust the position of the handgrip to place the hair styling accessory in line with and below the aeration tube so that the user can dry and style her hair at the same time when the hot air generator is in operation.

2. The hair dryer/styler of claim 1, wherein the bottom wall has a concave exterior surface.

3. The hair dryer/styler of claim 2, wherein the proximal end of the flexible hose is rotatably attached to the housing of the hot air generator.

4. The hair dryer/styler of claim 3, wherein the hair styling accessory is a cylindrical hairbrush.

5. The hair dryer/styler of claim 4, wherein the hairbrush comprises an elongated hollow body having a bristle portion and a connecting end attached to the bristle portion and sized to fit into the coupling ring member, and wherein the bristle portion has a plurality of spaced apart holes communicating with the passage of the handgrip.

6. The hair dryer/styler of claim 5, wherein the connecting end has a plurality of grooves on its exterior surface, and the coupling ring member has corresponding grooves on its interior surface so that the hairbrush does not rotate relative to the coupling ring member.

7. The hair dryer/styler of claim 6, wherein the fastener comprises a wristband borne by the housing of the hot air generator.

8. The hair dryer/styler of claim 7, which further comprise a conducting ring borne by the housing of the hot air generator and positioned apart from the wristband, the conducting ring being adapted to receive a finger of the user's hand thereby helping secure the hot air generator to the user's hand.

9. The hair dryer/styler of claim 3, wherein the hair styling accessory is a hair iron.

10. The hair dryer/styler of claim 9, wherein the hair iron has a hollow main body and a hollow connecting end attached to the main body and sized to be fit into the coupling ring member, and wherein the main body has an ironing plate having a plurality of spaced apart holes communicating with the passage of the handgrip.

11. The hair dryer/styler of claim 10, wherein the connecting end has a plurality of grooves on its exterior surface, and the coupling ring member has corresponding grooves on its interior surface so that the hair iron does not rotate relative to the coupling ring member.

12. The hair dryer/styler of claim 11, wherein the ironing plate has a smooth metallic coating on its exterior surface.

13. The hair dryer/styler of claim 12, which further comprises a second iron which is removably attached to the aeration tube and covers the side air outlet thereof, and wherein the second iron has an ironing plate having a plurality of spaced apart holes communicating with the side air outlet of the aeration tube.

14. The hair dryer/styler of claim 13, wherein the ironing plate has a smooth metallic coating on its exterior surface.

15. The hair dryer/styler of claim 14, wherein the fastener comprises a wristband borne by the housing of the hot air generator.

16. The hair dryer/styler of claim 15, which further comprise a conducting ring borne by the housing of the hot air generator and positioned apart from the wristband, the conducting ring being adapted to receive a finger of the user's hand thereby helping secure the hot air generator to the user's hand.

* * * * *